United States Patent [19]

Wicks

[11] Patent Number: 4,669,255

[45] Date of Patent: Jun. 2, 1987

[54] SADDLE PAD TO AID DIFFICULT HORSES

[76] Inventor: Lani Wicks, P.O. Box 862, Millbrook, N.Y. 12545

[21] Appl. No.: 796,172

[22] Filed: Nov. 8, 1985

[51] Int. Cl.[4] ..... B68C 1/12

[52] U.S. Cl. ..... 54/66

[58] Field of Search ..... 54/65, 66, 79

[56] References Cited

U.S. PATENT DOCUMENTS

| | | | |
|---|---|---|---|
| 31,409 | 8/1899 | Padgitt | 54/66 X |
| 87,295 | 11/1869 | Hogg . | |
| 351,212 | 10/1886 | Shaffer | 54/66 |
| 530,864 | 12/1894 | Torrey | 54/66 |
| 742,701 | 10/1903 | Maussner . | |
| 824,145 | 6/1906 | Reynolds . | |
| 949,101 | 2/1910 | Vance . | |
| 1,357,823 | 11/1920 | Read | 54/66 |
| 2,461,899 | 2/1949 | Humphrey | 54/66 |
| 3,323,287 | 6/1967 | Hilmer | 54/66 |
| 3,641,739 | 2/1972 | Stubben | 54/46 |
| 3,807,136 | 4/1974 | Deal | 54/66 |
| 3,971,194 | 7/1976 | Morgan | 54/66 |

FOREIGN PATENT DOCUMENTS

| | | | |
|---|---|---|---|
| 262995 | 12/1926 | United Kingdom | 54/66 |

*Primary Examiner*—Robert P. Swiatek

*Attorney, Agent, or Firm*—Bacon & Thomas

[57] ABSTRACT

A method of aiding difficult horses by using a saddle pad with protective extensions on each side measuring ten inches wide and ten inches long that cover the sensitive area of the intercostal nerve on the horse which affects the muscles in the lumbar region and hind legs, located just behind and twelve inches above the elbow. Stimulation in this area can cause some horses to become upset through being "cold-backed", sensitive and high strung, previously mistreated and/or injured and thereby difficult to girth, or young horses resistant to saddle and girth when being broken. One or more of these conditions can cause a horse to be uncomfortable and possibly uncooperative and difficult to train. The pad is constructed of top and bottom layers of cotton terry cloth or other suitable material and three inner layers of polyester fiberfill. These layers stitched together create a slight stretch providing a conforming fit to the horse's back and sides. The designated straps on the pad ensure a fit that will prevent slipping and wrinkling. The pad is thick enough for the comfort of the horse and thin enough to allow the rider a close feel of the horse. The protective extensions on each side allow the horse to be more comfortable, thereby more trainable. The best results are obtained by gradual tightening of the girth strap.

4 Claims, 6 Drawing Figures

SADDLE PAD TO AID DIFFICULT HORSES

BACKGROUND OF THE INVENTION

For many years horses have had a condition known as "cold-backed". A "cold-backed" horse is difficult to saddle and girth. When walking out and first mounted, the horse takes short, tense steps behind because of tight back muscles. There are varying degrees to this condition. A mild case would be uncomfortable and a severe case would cause the horse to rear upwards and/or collapse backwards when even the slightest girth pressure is felt.

Other horses may be sensitive and high strung. These horses may or may not be "cold-backed".

Then there are horses that have been mistreated, improperly trained and/or injured resulting in a sore back. Horses learn through association and possess an excellent memory. The memory of mistreatment and/or pain can cause the horse to become upset at even the sight of a saddle and the placing of the saddle on its back without the pressure of the girth strap. Sometimes young horses are resistant to saddle and girth when being broken. It is known and written that a horse can only be trained properly when in a relaxed state. It is not surprising then that a horse with one or more of the problems listed above is difficult to train. The invention disclosed herewith came about through my experience with a thoroughbred gelding I purchased who had all the problems listed above.

SUMMARY OF THE INVENTION

This invention is an aid for difficult horses having one or more of the conditions discussed in the background of the invention. It aids horses by means of covering the sensitive area of the intercostal nerve with protective extensions on each side of the saddle pad, measuring ten by ten inches. The protective extensions eliminate the concentrated pressure of the saddle flap and traditional saddle pad when they end in the same place by continuing past the saddle flap and the sensitive area of the intercostal nerve, providing even pressure and padding where the girth strap presses against the horses hide on the area of the intercostal nerve. This enables the horse to feel more comfortable, thus relaxing him, thereby enabling him to respond more to proper handling and training. Because of the horse's excellent memory and learning through association, this relaxed state created by the invention will be progressive in its success. By no means should it be considered as a substitute for proper handling and training.

The explanation of the sensitive area of the intercostal nerve may be found in the book entitled, *Thinking Riding* by Molly Sivewright, published in 1979 by J. A. Allen & Company Limited, London. Information on the intercostal nerve my be found on pages 235–241.

DESCRIPTION OF THE PREFERRED EMBODIMENT

Figure 1:
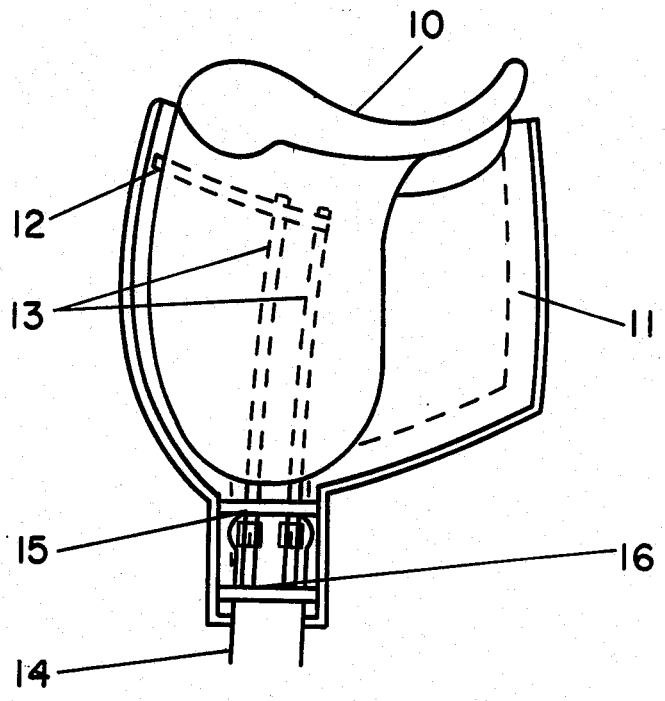
FIG. 1 is a side view of a dressage saddle with the saddle pad according to my invention.

Referring to the drawings using reference numerals to identify the elements of structure, FIG. 1 shows a dressage saddle 10, with a corresponding version of saddle pad 11, with protective extensions according to my invention. Saddle pad 11 is held securely in place between the horse and saddle 10 by means of a strap 12 made from the same material as the outer layer of the saddle pad 11 with a loop at the end to slide onto the billet strap 13 of the saddle 10. The other end of the strap 12 is stitched on the saddle pad 11 through all thicknesses. The girth strap 14 passes through between the protective extensions and straps 15 and 16, preventing the saddle pad 11 from slipping out of place. Further details of my invention are disclosed in FIGS. 3 and 4.

Figure 2:
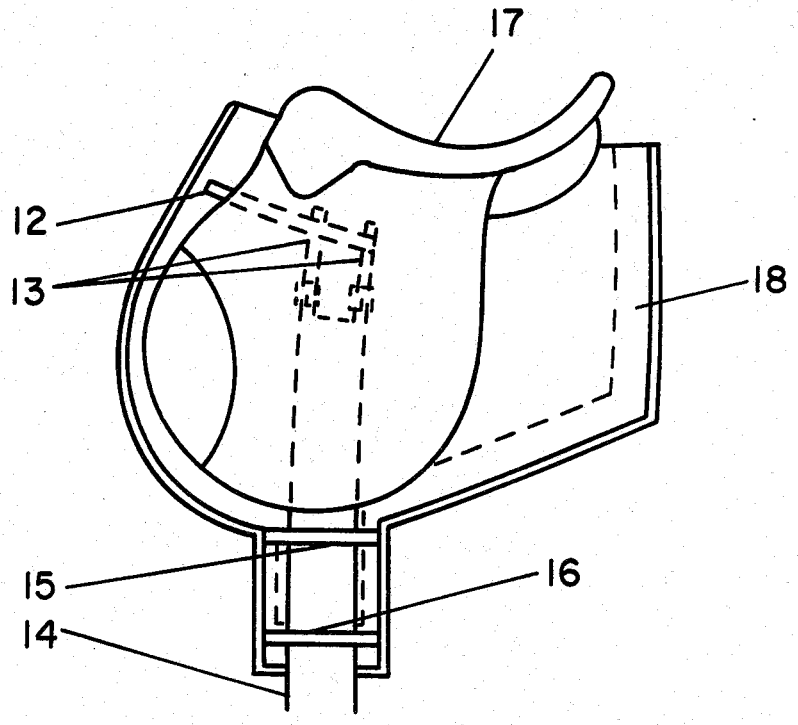
FIG. 2 is a side view of an all-purpose or jumping saddle with the saddle pad according to my invention.

FIG. 2 shows an all-purpose or jumping saddle 17 with a corresponding version of saddle pad 18 with protective extensions according to my invention. This version of saddle pad 18 has the same straps 12, 15, and 16 as described in FIG. 1 as shown.

Figure 3:
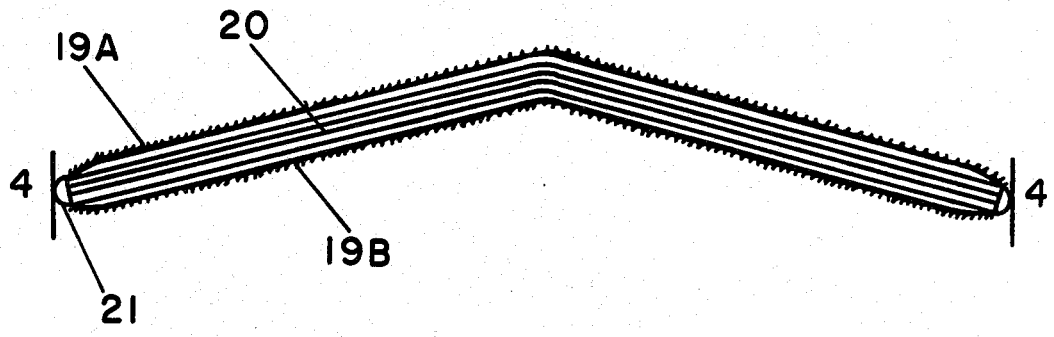
FIG. 3 is a transverse cross sectional view of the saddle pad according to my invention.

In FIG. 3 a transverse cross-sectional view is shown of my invention, being the same for FIGS. 1 and 2 except for the length of the pad for one end of the protective extension on one side to the end of the protective extension on the other side, designated by lines 4. The length of saddle pad 11 is 56 inches and saddle pad 18 is 52 inches. My invention is constructed mainly of two materials. The outer layers 19A and 19B are durable terry cloth of quality cotton or other suitable material. The three inner layers 20 are polyester fiberfill sheets. This interaction of layers 19A, 19B and 20 gives pads 11 and 18 a soft cushion without too much bulk, thereby creating a slight stretch and ensuring a conforming fit to the horse, eliminating wrinkles that may cause the horse discomfort. The rough edges of the pads 11 and 18 are bound together by a 3 inches wide trim 21 made of cotton.

Figure 4:
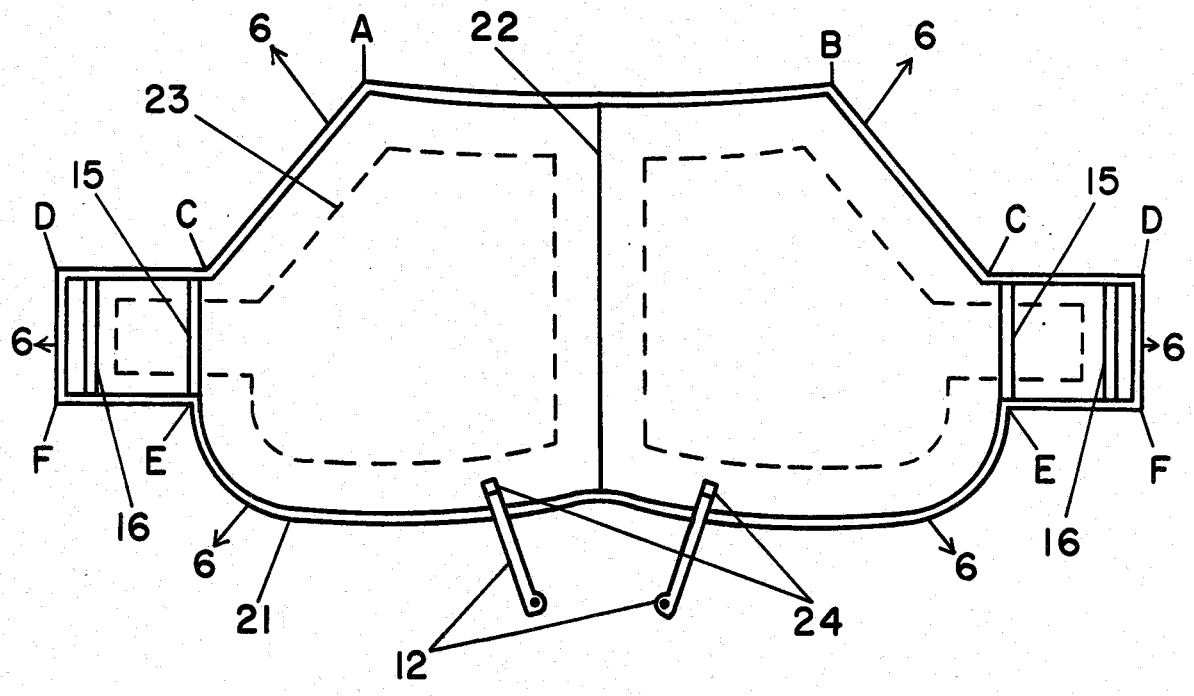
FIG. 4 is a plan view of the saddle pad according to my invention.

Disclosed in FIG. 4 is a plan view of my invention, lying in a flat position. Saddle pad 11 is shown with the understanding that the construction is the same for saddle pad 18 except for the difference in shapes of saddles 10 and 17, and the difference in length as explained in FIG. 3. The other length is the same for pads 11 and 18 which is the length between points A and B, which is 30 inches. The lengths between points C and D and E and F is 10 inches which is the same length between points D and F and C and E.

Continuing with FIG. 4, line 6 indicates by the arrows the slight stretch created by the interaction of layers 19A, 19B and 20 as explained in FIG. 3. To construct pad 11, two identically shaped pieces of terry cloth or other suitable material are stitched together to form the top layer 19A, with center seam 22. The same process is then repeated to form bottom layer 19B. The three inner layers 20 are then stitched together in the same manner except three layers are stitched together instead of one. The top and bottom layers 19A and 19B are then placed respectively with the inner layers 20 inside and stitched together through all thicknesses indicated by the dotted lines 23. A $\frac{5}{8}$ inch seam is then stitched all around the outer edge. The straps 12, 15, and 16 are then stitched in through all thicknesses. Strap 12 is stitched on at one end in the proper place 24 so as to attach the loop end to the billet strap 13 of the saddle. Straps 15 and 16 are stitched on at both ends in the same stitching line as the $\frac{5}{8}$ inch seam. The final step is stitching on the edge trim 21 using two rows of parallel stitching through all thicknesses with the trim 21 being folded over the rough edges of the pad so that one half is on the top and the other half is on the bottom.

Figure 5:
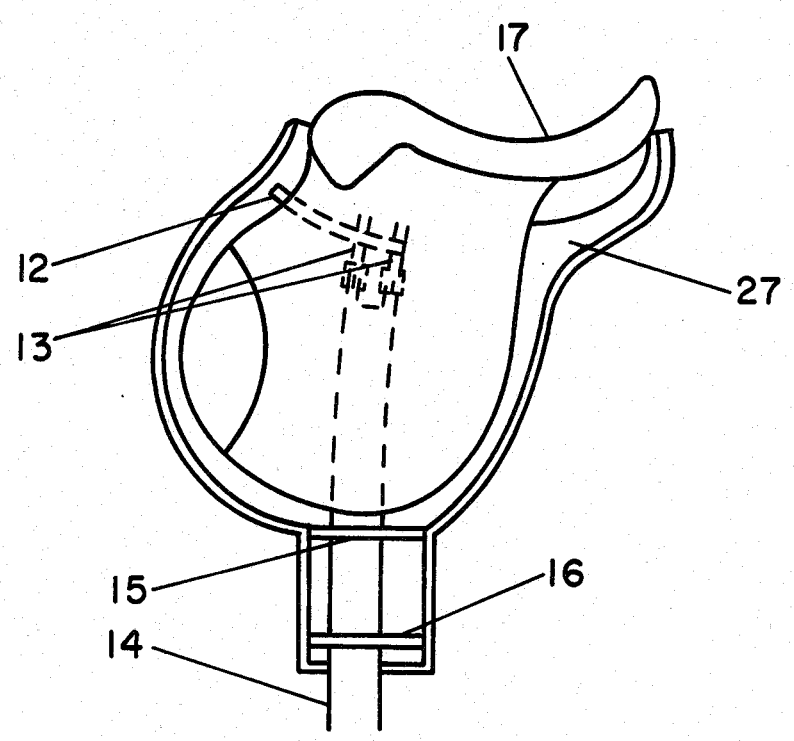
FIG. 5 is a side view of an all-purpose or jumping saddle using a traditional, saddle shaped pad according to my invention.

FIG. 5 shows another version of the saddle pad with the protective extensions according to my invention, shown here with saddle 17. This version is the shape of a traditionally shaped saddle pad with the protective extensions according to my invention.

Figure 6:
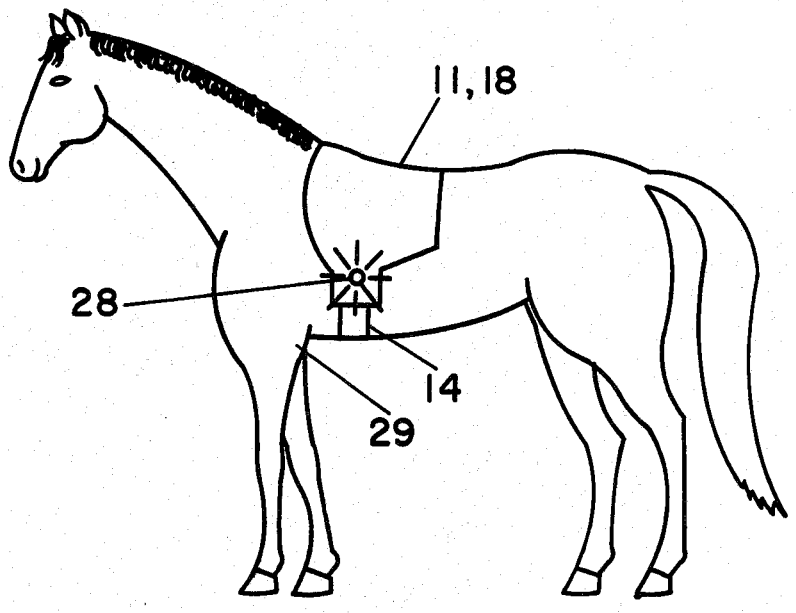
FIG. 6 is a side view of a horse showing the placement of the saddle pad according to my invention without a saddle.

In FIG. 6, a horse with the saddle pad according to my invention is shown placed properly on its back. The intercostal nerve 28 is located just behind and twelve inches above the elbow 29. My invention covers the intercostal nerve 28 and the girth strap 14 passes directly over the intercostal nerve 28 as indicated by showing the part of girth strap 14 that goes around the horses underside, and comparing the placing of the girth strap 14 to the saddles in FIGS. 1, 2, and 5.

What is claimed is:

1. A non-rectangular saddle pad comprising a top layer of material, a bottom layer of material and an inner layer of material between said top and bottom layers, said layers of material being fastened together at the boundary of the pad to provide for stretching of the layers of material; said pad having a front pad edge and a rear pad edge; said pad having a configuration such that it completely covers the area of contact of a saddle when in position on a horse; sand pad having an extension on each side thereof, each said extension extending beyond the area of contact of the saddle and each said extension including a front and rear extension edge with said rear extension edge extending from the pad at a point between the rear pad edge and the front pad edge such that each extension covers the area of the horse where the girth strap from the saddle passes over the intercostal nerve of the horse.

2. The saddle pad as claimed in claim 1, wherein each of said extensions contains two parallel straps for holding the girth strap of a saddle.

3. The saddle pad as claimed in claim 1, wherein said top and bottom layers of material are terry cloth.

4. The saddle pad as claimed in claim 1, wherein said inner layer of material comprises polyester fiberfill sheets.

* * * * *